US005319904A

United States Patent [19]

Pascoe

[11] Patent Number: 5,319,904

[45] Date of Patent: Jun. 14, 1994

[54] PORTABLE PREFABRICATED MODULARIZED CLUSTERABLE STRUCTURES

[76] Inventor: Jack F. Pascoe, 3941 Cedar Dr., Walnutport, Pa. 18088

[21] Appl. No.: 737,973

[22] Filed: Jul. 30, 1991

[51] Int. Cl.[5] ..... E04B 7/00

[52] U.S. Cl. ..... 52/82; 52/79.5; 52/584.1

[58] Field of Search ..... 52/79.5, 79.7, 79.8, 52/82, 205, 207, 595, 584, 80

[56] References Cited

U.S. PATENT DOCUMENTS

| | | | |
|---|---|---|---|
| 3,148,380 | 9/1964 | Hanson | 52/79.7 X |
| 3,763,608 | 10/1973 | Chamlee | 52/80 |
| 3,835,602 | 9/1974 | Tuuri | 52/82 |
| 3,999,337 | 12/1976 | Tomassetti, Jr. et al. | 52/82 |
| 4,655,013 | 4/1987 | Ritland | 52/82 X |
| 4,672,779 | 6/1987 | Boyd | 52/79.5 |
| 4,951,432 | 8/1990 | Wilkinson | 52/79.5 X |
| 5,033,243 | 7/1991 | Worms et al. | 52/82 |

FOREIGN PATENT DOCUMENTS

| | | | |
|---|---|---|---|
| 2631360 | 11/1989 | France | 52/80 |

*Primary Examiner*—Carl D. Friedman
*Assistant Examiner*—Kien Nguyen
*Attorney, Agent, or Firm*—Sanford J. Piltch

[57] ABSTRACT

A prefabricated building structure having a truncated, cone-like sidewall structure fabricated from a plurality of conjoined, arcuate surface sidewall panels with adjacent panels being interconnected by an external interruptible means. The sidewall panels, mounted on corresponding flooring panels, separately support conjoined ceiling panels which are of a wedge-shaped planar configuration and have a truncated inner end flanged upwardly for locking engagement with a central closure means. Various selectable insert panels or modules are engageable within the sidewall panels to provide a structure adapted to a variety of utilities including, but not limited to, housing and storage.

9 Claims, 11 Drawing Sheets

PORTABLE PREFABRICATED MODULARIZED CLUSTERABLE STRUCTURES

FIELD OF THE INVENTION

This invention relates to a prefabricated modular building formed from a plurality of conjoined preformed discrete flooring, sidewall, and ceiling panels.

BACKGROUND OF THE INVENTION

The need for rapidly assembling habitable structures invariably occurs due to disasters, whether by an act of nature or man-made. Such sheltering structures must often be set up in harsh climactic conditions rather quickly and for indeterminate periods; only later to be broken down for ready transport to another emergency locale. Beyond transient uses as described, longer term, sturdier housing is needed in remote areas which are lacking in the natural materials for constructing of living space or quarters, such as the polar regions and bleak deserts. Also, transport capacity for conventional structures is impractical, short of being air-dropped, because of a lack of suitable roads. Clearly, it will be appreciated that a modular, but sturdy, building, which is deftly and quickly assembled from light weight components, which are adapted to harsh conditions, is desirable.

Also in isolated areas, hazardous waste containment structures are sometimes needed which must prove sturdy in harsh environments to retain the contained fluids, like liquids or partly compressed gases. Such waste retention structures may be utilized either underground, or submerged, which are capable of withstanding appreciable hydrostatic pressures.

Just as important as rapid assembly under stress conditions is the ready recovery of the modular elements for removal and reuse at another time and place.

Accordingly it is a principal object of the invention to provide a readily assembled, double-walled, insulated, personnel or material containment and storage structure, also suited for harsh ambient climactic conditions, such as extreme temperatures, and capable of withstanding submerged hydrostatic pressures or compression forces in unstable underground formations.

It is another object of the invention to provide a modular panelized structure which is comparatively lightweight, but of sufficient structural integrity, which is readily transportable before assembly and upon breakdown, and which provides for cost effective storage and containment of a variety of commodities.

It is a further object of the invention to employ marginal panelized construction to assemble a substantially air-tight containment means suitable for the storage of bulk solids or liquids within an integral liner, which liquids may be toxic or be comprised of hazardous waste material.

A still further object of the invention is to provide a modular storage assembly adapted for including accessories like doors and windows that can convert the modular assembly into living and working facilities.

Still another object of the invention is to provide accessory panels that create interconnecting passageways for modular unit coupling permitting the fabrication of plural units in the nature of a honeycomb matrix.

Other objects and advantages of the present invention will become apparent from the following detailed description.

SUMMARY OF THE INVENTION

According to the present invention, there is provided a prefabricated, modular building assembly adapted for essentially hermetic sealing and/or pressurized operation, comprising a plurality of wedge-shaped flooring panels, adapted in number and arcuate length (span) such that, when the flooring panels are laterally conjoined, they present a substantially circular contiguous planar flooring component. A like number of sidewall panels of an arcuate span sufficient so that, when laterally conjoined, they form a circular contiguous, frustum-like sidewall assembly, presenting an open-ended cylinder having an upper opening slightly smaller than the lower opening. The upper opening being adapted to receive a plurality of light weight, substantially wedge-shaped preformed ceiling panels, being similar in number and arcuate span to the flooring panels so that, when laterally conjoined, they also serve to present a tight junction with the underlying conjoined sidewall panels along their opposing external edges. The ceiling panels further defining a central opening along their inner conjoined edges, which central opening is substantially smaller than the upper opening of the conjoined sidewall panels. Closing the second opening is, generally, a rounded (circular) ceiling or roof panel, adapted to frictionally and sealingly engage along its recessed peripheral undersurface with the internal upper periphery of the conjoined ceiling panels at the location of the central opening. In a preferred embodiment, the internal arcuate edges of each ceiling panel are flanged upwardly, presenting an upward circular configuration for mating with a ceiling closure module.

BRIEF DESCRIPTION OF THE DRAWINGS

For the purpose of illustrating the invention, there are shown in the drawings forms which are presently preferred; it being understood, however, that the invention is not limited to the precise arrangement and instrumentalities shown.

DESCRIPTION OF THE PREFERRED EMBODIMENT

The following detailed description is of the best presently contemplated modes of carrying out the invention. This description is not intended in a limiting sense, but is made solely for the purpose of illustrating the general principles of the invention.

Figure 1:
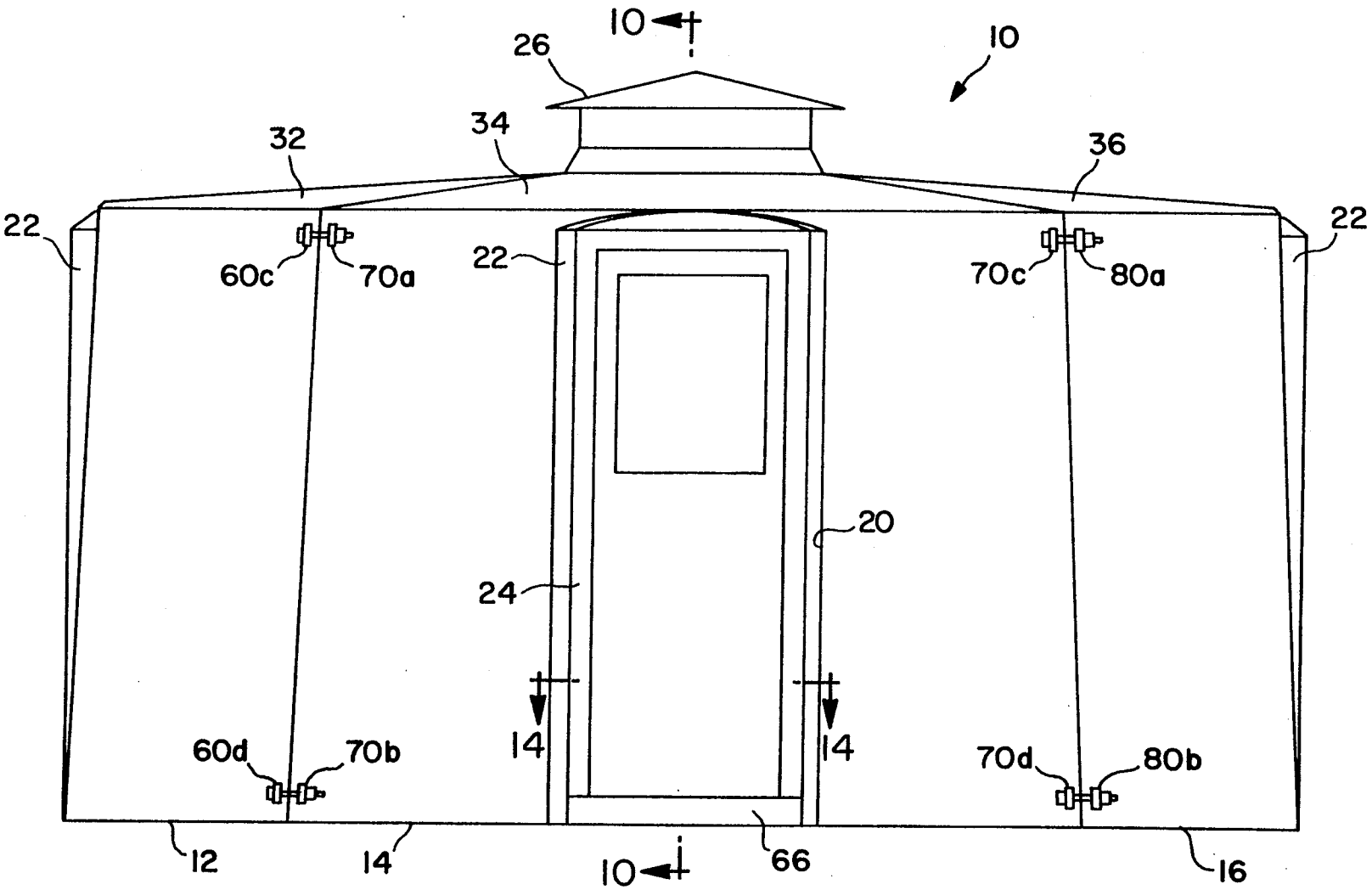
FIG. 1 is a front elevational view of an assembled first embodiment of the present invention including an integral modifiable panel insert with operable door means.

Referring now to the drawings in detail, where like numerals represent like elements, there is shown in FIG. 1, in particular, an assembled embodiment of the present invention, a prefabricated modular structure 10. The structure 10 comprises a plurality of flooring, sidewall and ceiling panels, conjoined to form the structure, with a number of selectable insertable modular panels having a predetermined function for use with the sidewall panels and conforming closure and fastening means.

The structure 10, as shown in FIG. 1, includes conjoined contiguous sidewall panels 12, 14 and 16, and another sidewall panel 18 diametrically opposite sidewall panel 14 (not shown in FIG. 1). With reference to sidewall panel 14, there is also provided a horizontally centered substantially rectangular opening 20, in which a nested removable frame insert 22 adapted for receiving one of a plurality of insert panels 24 is located. Each of the insert panels 24 are configured for operable doors or windows, or for an imperforate or blank panel as a contiguous wall segment. The sidewall panel opening 20 is also adapted to alternately provide for an imperforate or blank insert or fixed or operable window insert panel, which serve, respectively, as a continuous wall segment or a view port without resort to the nested removable frame insert 22. The various insert panels, their individual function and operation, and the manner of insertion of these panels and the maintaining of the structural integrity will be described in much greater detail hereinafter.

Positioned at the topmost central location of the structure 10 is a removable cupola-type ceiling panel closure module 26 which is adapted to secure the inward facing edges of the plural ceiling panels 32, 34, 36, and 38 (not shown), and adapted to make sealing engagement therewith. The structure 10 is usually mounted onto a leveled planar flooring platform (see FIG. 2) with which it will make sealing engagement in a manner to be described.

Figure 2:
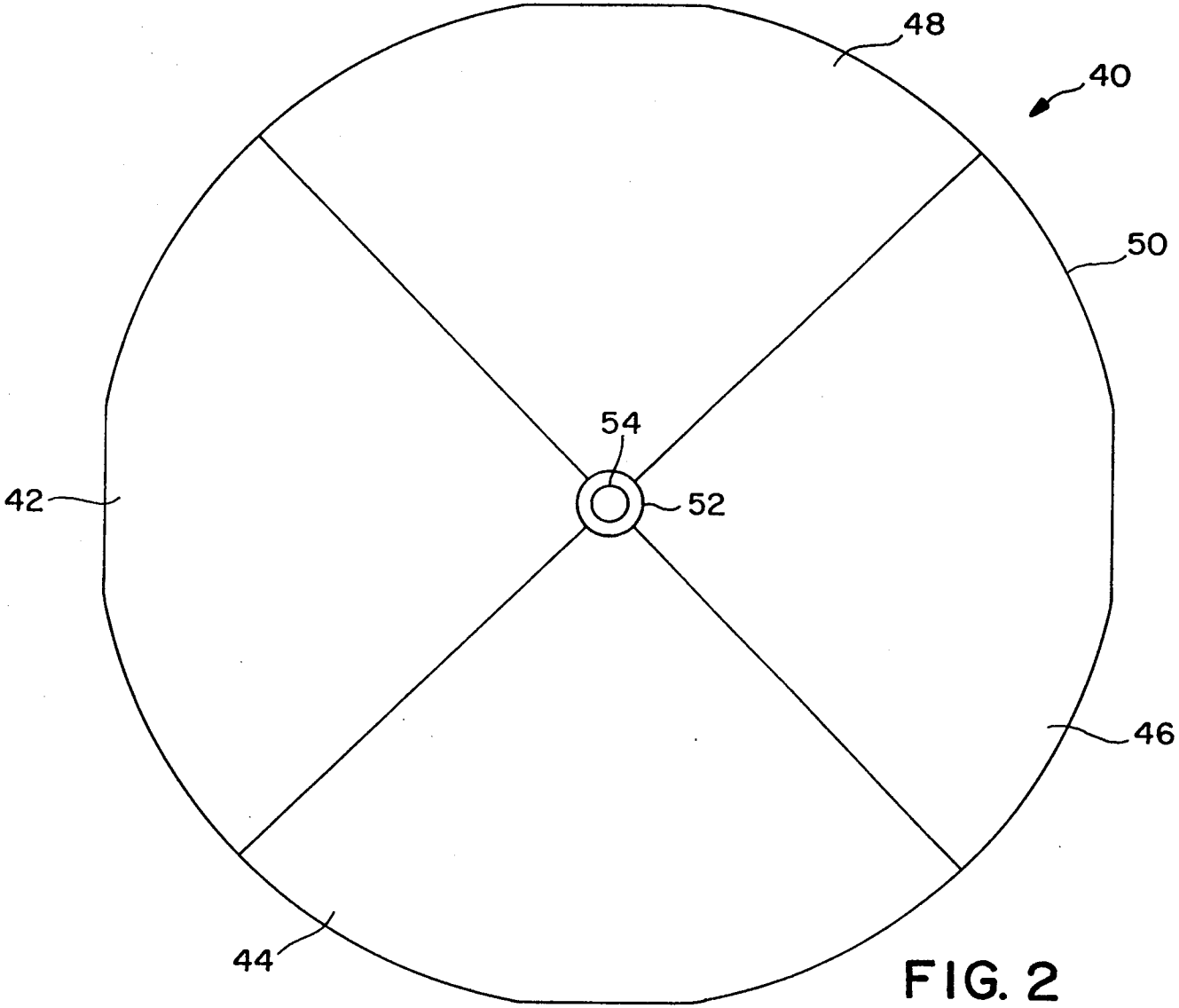
FIG. 2 is a top plan view of a set of assembled flooring segments arranged in a conjoined mode, adapted to accept the mounting of modularized sidewall panels thereon.

A flooring platform 40, ready to receive the bottom edges of the plural sidewall panels 12–18 is shown in FIG. 2. This top plan view of a representative number of planar, substantially pie-shaped flooring segments, 42, 44, 46, and 48, (in this example four segments) is presented in a conjoined mode. The outer circumferential edge 50 will coincide with the bottom edges of the curvilinear sidewall panels, 12, 14, 16, and 18 and make sealing engagement therewith. A central flooring panel locking member 52 provides the seal required for the stability and integrity of the flooring 40. The central locking member 52 may include an optional port 54 for connecting to the outside. This port 54 may be used for introducing or extracting fungible materials to and from the space within the structure 10 by valving and/or piping means and for the introduction of atmosphere conditioning, e.g. heating and air conditioning, to the structure, as well as electrical and plumbing connections.

Figure 3:
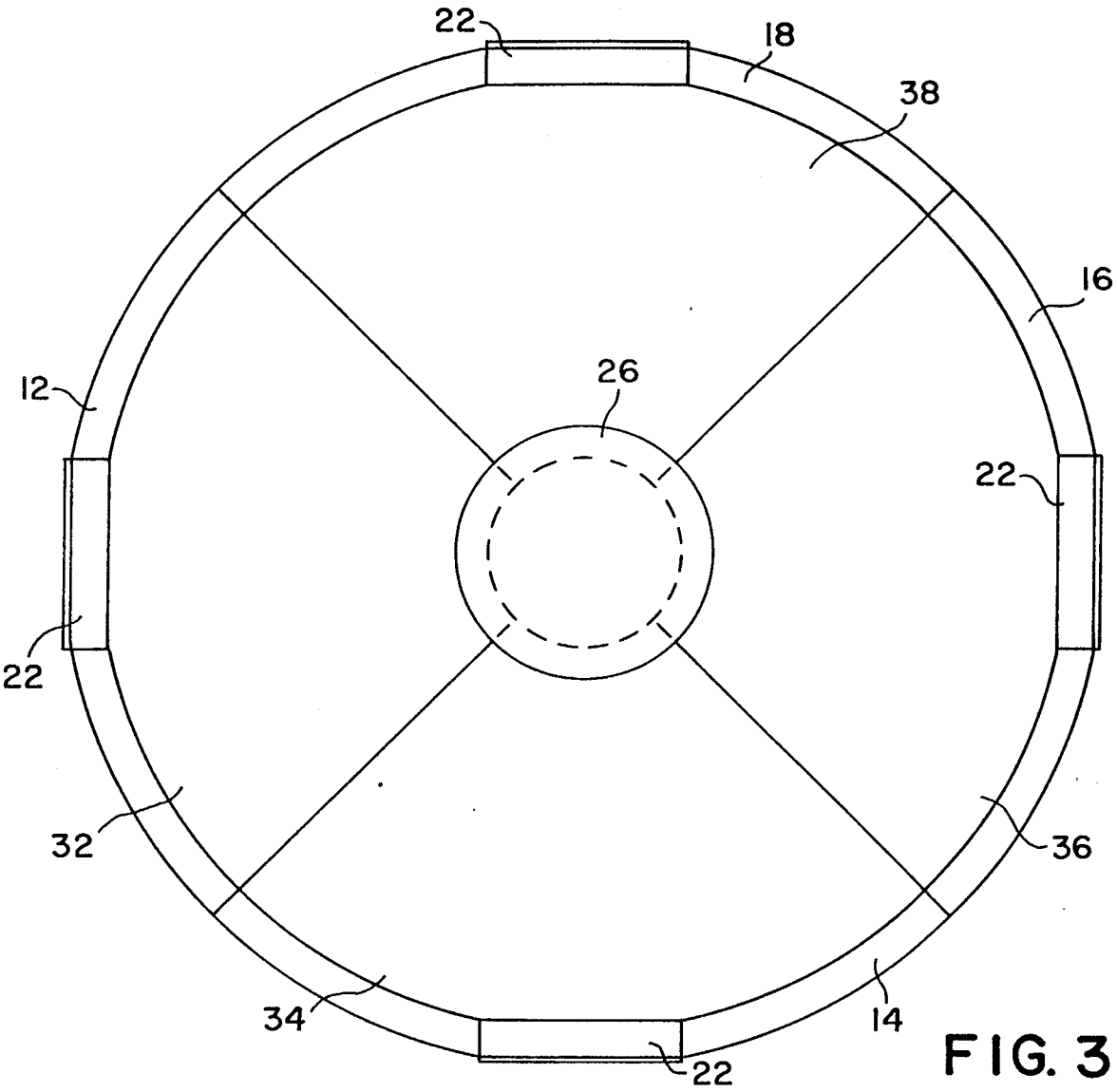
FIG. 3 is a top plan view of the assembled embodiment of FIG. 1 including a central ceiling panel closure.

Referring now to FIG. 3, the assembled structure is shown including the ceiling or roof closure means 26, which overlies the upturned inward facing curvilinear edges of the ceiling panels 32–38. The view from above clearly establishes the flattening (or straightening) of the curvilinear outer surface of the various sidewall panels 12–18 along the central portion of their respective bases, and also the substantially vertical outer surface of the nested insert panel frames 22. Although only a series of four modular panels are depicted for use in the flooring, sidewalls and ceiling panels (each having a 90° arcuate span), it is quite practical to provide additional sets of mating panels for larger dimensioned structures, like 10. It is also possible to vary the arcuate dimension of the mating panels to less than 90°, which would permit an increase in the number of panel sets; six (6) panel sets for a substantially hexagonal structure, eight (8) panel sets for a substantially octagonal structure, and so forth. The increase in the number of panel sets would add to fabrication costs, but is preferred with assembled structures of significantly enlarged dimensions to retain the necessary structural integrity. Ready manipulation and erection of the various modularized panel sets is a limiting parameter for minimizing the absolute number of sets of modularized panels required for a single structure 10 of FIG. 1.

Figure 4:
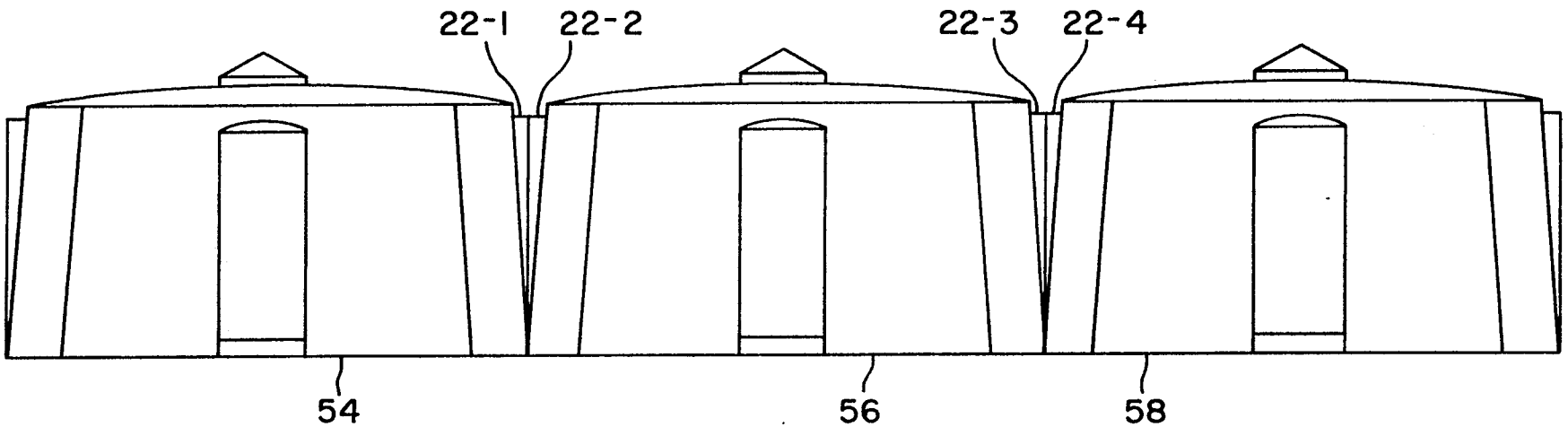
FIG. 4 is a joined array of the assembled embodiment of FIG. 1 of the invention.

FIG. 4 shows a series of structures, of the type structure 10 of FIG. 1, interconnected to form segments 54, 56, and 58. This is accomplished by employing identical opposing sidewall panel nested frame inserts 22 to provide matable interconnecting projections. By way of example, the sidewall panel nested frame insert 22-1 of structure 54 will abut and matably seal against the opposing sidewall panel nested frame insert 22-2 of structure 56. On the diametrically opposite sidewall of central structure 56, sidewall panel nested frame insert 22-3 abuts and matably seals against the opposing sidewall panel nested frame insert 22-4 of structure 58. The external (lateral) faces of all the structures are provided with sidewall panel nested frame inserts 22 and insert panels 24 for the access/egress portals. Similarly, additional structures 10 can be joined with any outer sidewall of the interconnected structures of FIG. 4, in any direction, to form a variable volume array of interconnected structures of the present invention.

Figure 5:
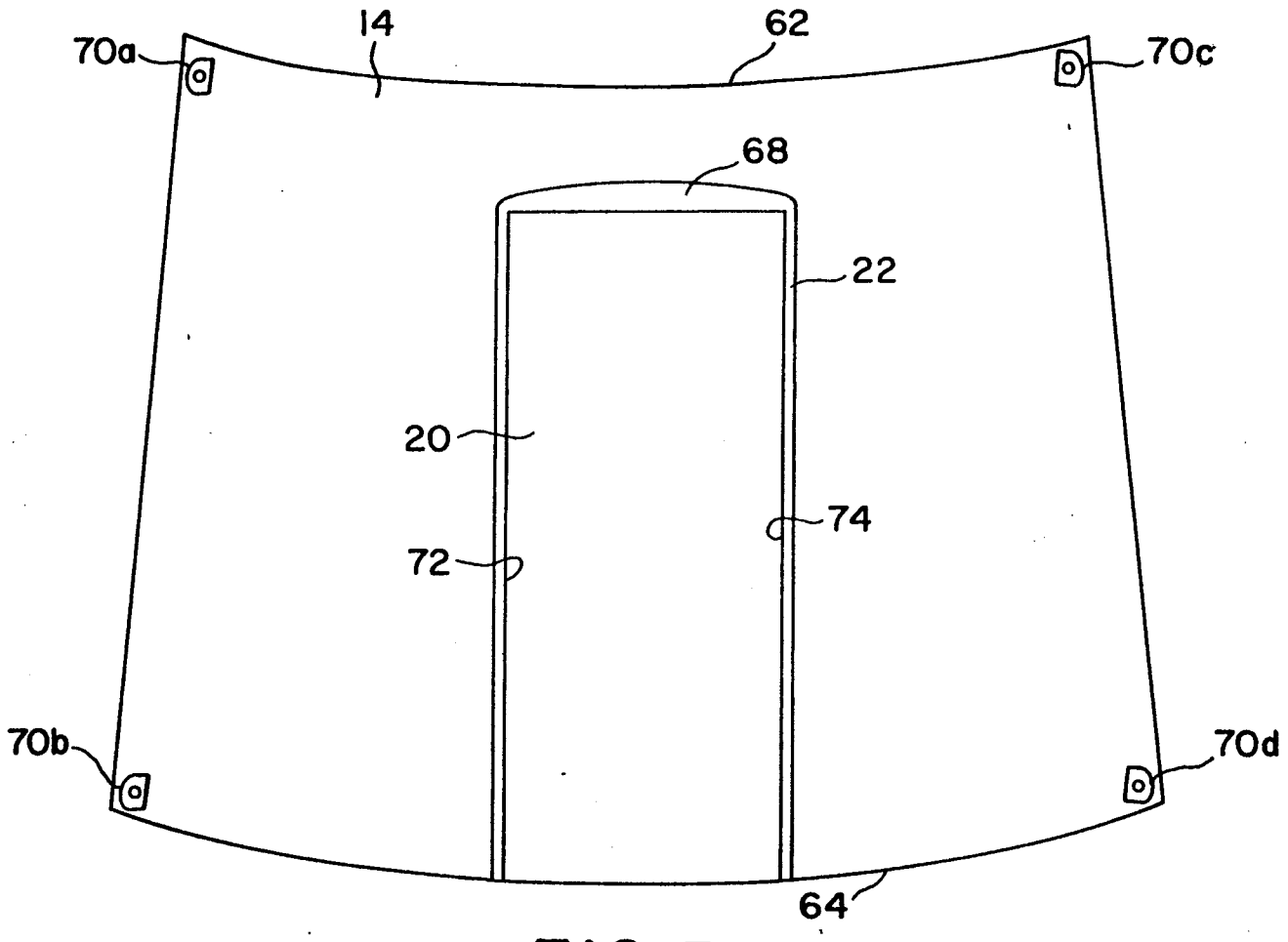
FIG. 5 is an elevational view of a curvilinear sidewall panel having a substantially rectangular opening for selected sidewall panel module insertion.

FIG. 5 is a perspective view of isolated sidewall panel 14, with a nested frame insert 22, but without insert panel 24 installed in position. In this view, the curvilinear edges of both the upper edge 62 and lower edge 64 can be seen to describe an arc, in the case of the described example of the preferred embodiment the arc is 90°. Thus, in the case of the present example, only four such sidewall panels 14 are needed to form a the structure 10 of the present invention. Describing the sidewall panel 14, the opening 20 extends for substantially the entire vertical height of the sidewall panel 14 in order to accommodate the nested frame insert 22 and the insert panel 24 provide the structural integrity along the sidewall panel lower edge 64 by providing partial (in the case of a window panel) or full intermediate wall segment, or (in the case of a door panel) a connecting member 66 spans the insert panel 24 adjacent the lower edge. The curvilinear arched upwardly facing surface 68 of the nested frame insert 22 provides the bridge between the upright outer surface of the frame insert 22 and the curvilinear external surface of the sidewall panel 14, and also receives the upper edge of one of the selectable insert panels 24. The nested frame insert 22 may be incorporated into the sidewall panel 14 providing the nesting surface integral with the panel 14 and accommodating the interchangeability of insert panel 24 in the sidewall panel. Alternately, the nested frame insert 22 may be eliminated and a fixed "blank" or non-operable window insert panel may be utilized which insert panel provides inner and outer surfaces coincident with the curvilinear surface of the sidewall panel 14. Located at each corner of the sidewall panel 14 are attachment fittings 70*a–d* for use in securing the individual sidewall panel segments of the structure one to the other which will be described in greater detail hereinafter.

Figure 6:
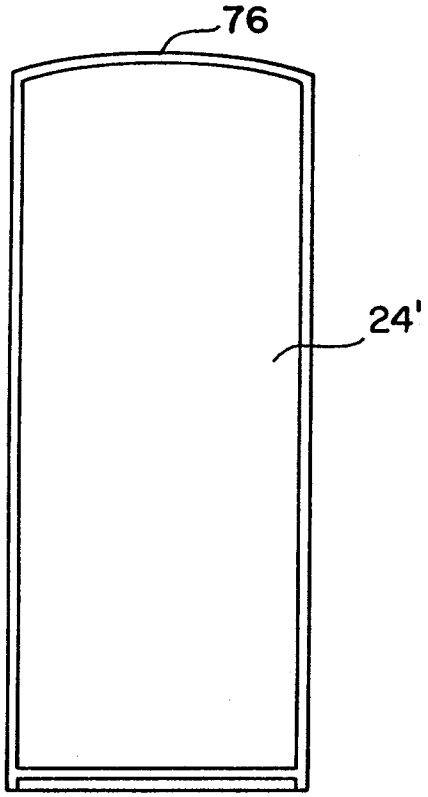
FIG. 6 is a blank panel modular insert adapted for insertion into the substantially rectangular sidewall opening of FIG. 5.

Planar "blank" insert 24 may be used as one of a group of insertable panels set into the nested frame insert 22 or in place of the nested frame insert 22 directly into the sidewall panel 14, but with slightly altered external dimensions. When used as an insert directly into the sidewall panel 14, the "blank" insert 24' of FIG. 6 is inserted from the lower edge 64 of sidewall panel 14 by sliding engagement with the lateral walls 72 and 74 of sidewall panel 14 by an edge joinder means to be described more fully following. The insert panel 24' mates in abutting sealing engagement with all of the lateral surfaces and is held in place by erection of the sidewall panel 14 against the corresponding flooring panel. The insert panel 24' has an arcuate upper edge 76 which is configured to match the curvilinear outer surface of the sidewall panel 14 just as the nested frame insert 22 has the arched upper surface 68 for matching the curvilinear outer surface of the sidewall panel 14. In the event that the opening 20 is not desired to hold an insert, a connecting member 66, providing an integral spacer between the lateral walls of the opening 20, will be utilized across the lower edge 64 of the sidewall panel 14.

Before continuing with the description of the joining and interconnection of the various segments of the structure 10, it is important to describe the composition of the materials from which the structure is manufactured. Each of contoured sidewall panels, the flooring panels, the ceiling panels, and the insert panels, is comprised of an outer wall layer or skin of the panels is of fiberglass. However, Kevlar® fabric, for conferring strength and potential projectile imperviousness may be added to the panels. The inner wall layer or skin is of the same material. Each "skin" is preferred to be approximately 0.1875 to 0.25 inches thick, uniformly across the various panels. An insulating core of stiffened polyurethane, with an optional insulating semi-rigid plastic, is sandwiched between the two "skins". The "core" is nominally 3.5 inches thick to provide an overall thickness dimension of 4.0 inches. Although other dimensional thickness requirements may be found to be suitable, as well as other materials, the foregoing is the presently preferred structure. The described structure of the panels not only imparts rigidity to the panels but also provides both thermal and acoustic insulating features.

Figure 7:
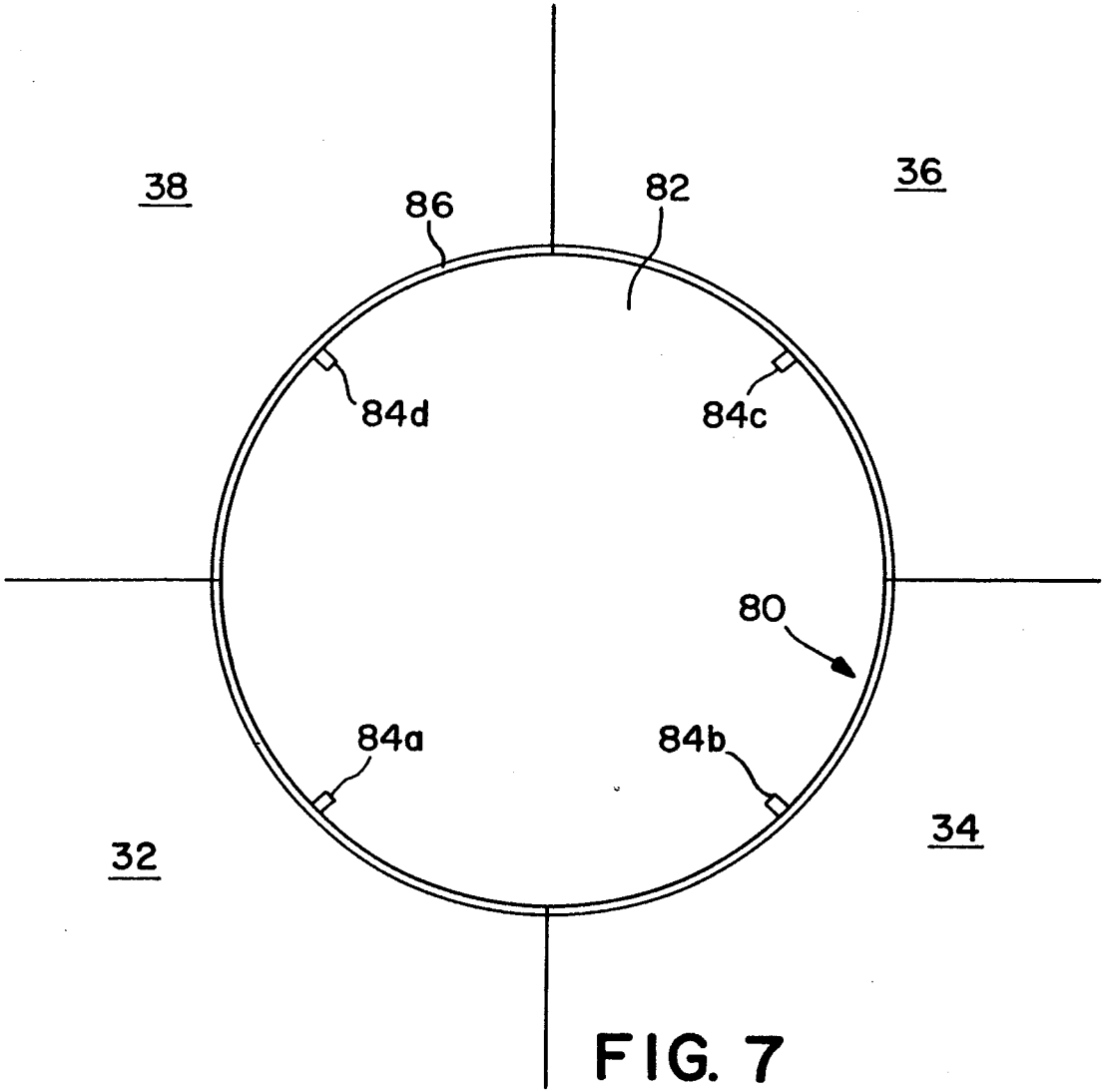
FIG. 7 is a fragmentary top plan view of the conjoined ceiling panels of FIG. 4 showing the central opening and ceiling closure fastening means.
Figure 8:
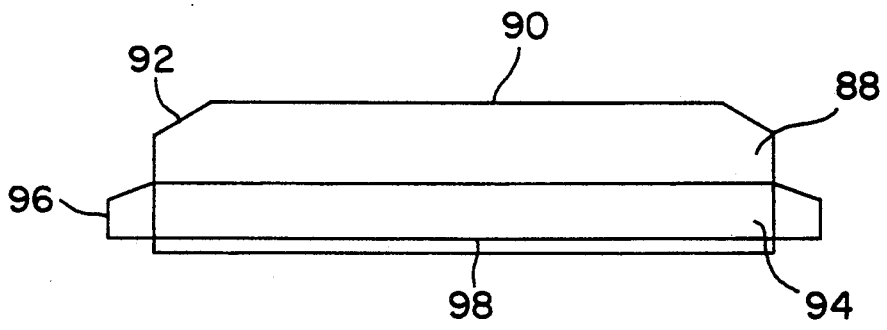
FIG. 8 is a side elevational view of one embodiment of the ceiling closure means.

The fragmentary view of FIG. 7 is of a central roof or ceiling portion of a partially assembled structure 10 with the ceiling closure module 26 (one example of which is shown in FIG. 8) being omitted. The viewable structure reveals that the joined ceiling panels 32–38 are also provided on their inner periphery with arcuate cutouts, like 80. These cutouts 80 create a selectable dimensioned circular aperture 82 upon conjoining. The inwardly projecting, spaced-apart attachment fittings 84*a–d*, which are located centrally along the inward facing edge of each ceiling panel, serve as anchoring-/retaining points for the closure module 26 which has like mating attachment fittings through which a nylon bolting means is inserted to hold the segments in a tight fitting sealing relationship. Typically, the ceiling aperture 82 is three feet in diameter, but may have a smaller diameter. Each of the ceiling panels 32–38 has an inward facing edge curving upward describing a 90° arc to meet the ceiling closure module 26. This upward facing annular flange 86, having a preferred width of 2.0 inches, mates in abutting sealing engagement with the closure module 26.

A side elevational view of one form of the ceiling closure module 26 is presented in FIG. 8. The upper member 88, which serves to cover the ceiling aperture 82, typically has a height of 12.0 inches with an upper planar surface 90 (within the beveled edges 92) having a diameter of two feet. The lower member 94 is comprised of an annular ring 96 about its periphery approximating 4.0 inches high by 4.0 inches in radial dimension and a circular collar 98 extending downward into the ceiling aperture 82, which circular collar 98 carries mating attachment fittings for mating with the fittings 84*a–d*. The annular ring 96 is slightly larger in radial dimension than diameter of the ceiling aperture 82 of the ceiling panels 32–38 of FIG. 7 so that the closure module 26 will fit over the peripheral flange 86 as it is configured to mate with the curvilinear outer surface of the ceiling panels 32–38.

Figure 9:
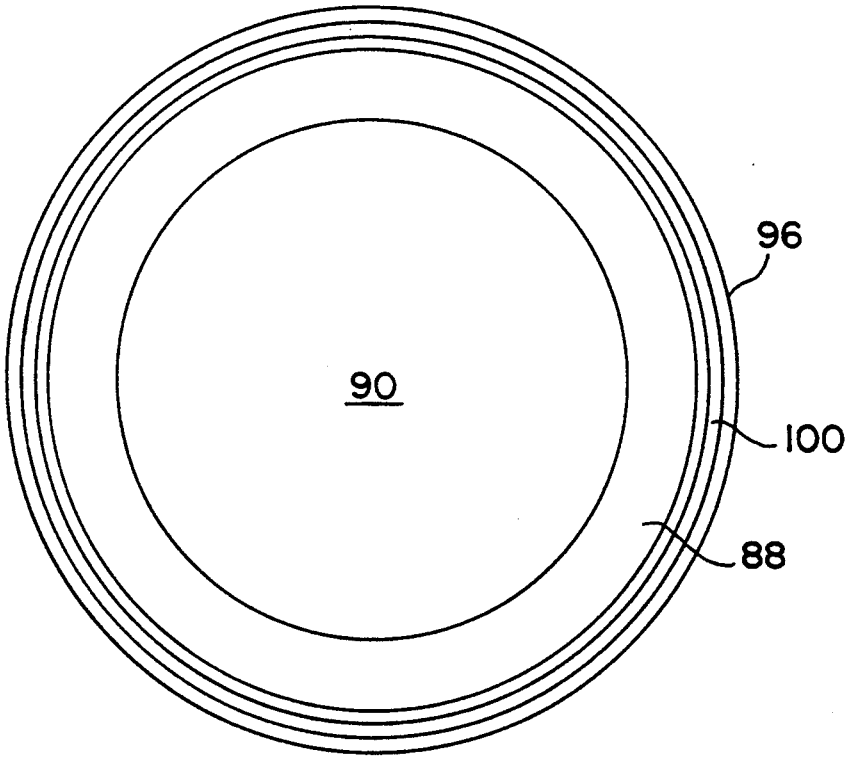
FIG. 9 is a bottom plan view of the ceiling closure means of FIG. 8.

The annular ring 96 contains an annular recess 100 for fitting over and sealingly mating with the peripheral flange 86 of the ceiling panels 32–38, thus closing the ceiling aperture 82. A bottom plan view of the closure module 26, showing the annular recess 100, is shown in FIG. 9. The manner of sealing engagement will be described in connection with a discussion pertaining to all of the mating joints between and among the various panels and inserts.

Figure 10:
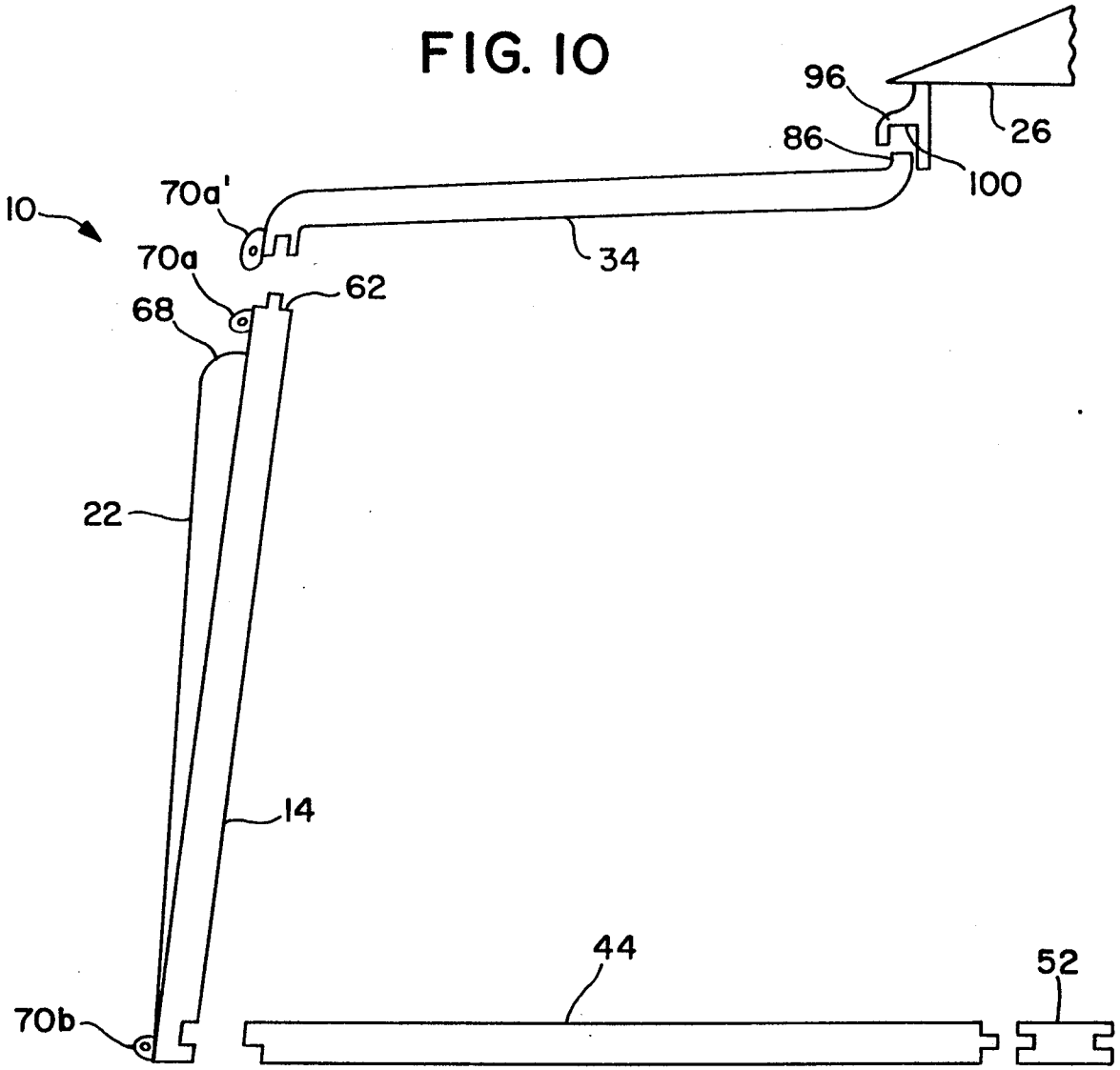
FIG. 10 is an exploded vertical sectional view of the shelter assembly, taken substantially along line 10—10 of FIG. 1.

The vertical sectional view of FIG. 10 best depicts how the various panels, inserts, and modules of the structure 10 are fit together to form modularized structure of the present invention which provides the structural integrity and adaptability required in accordance with the invention.

The outer circular edge of planar flooring panel 44 readily forms a modified mortice and tenon type joint with the lower inner surface of sidewall panel 14. An outwardly projecting, downwardly tapering section of the nested frame insert 22 is seen in profile extending outward from sidewall panel 14. Given the slight inward incline from the bottom to the top of each sidewall panel 14 to promote structural integrity, the nested frame insert panel 22 is required to extend outward farther at the top to provide a vertical mating surface for like panels to counter the inward displacement of the sidewall panel 14 of 4.0 inches.

The upper edge 62 of each such sidewall panel 14 has a tenon extending upward into a mating mortice groove in the opposing ceiling panel 34. The mortice groove snugly receives the upwardly projecting tenon into the undersurface of the ceiling panel 34 within a section of said panel which is turned downward at approximately 90° to the incline of the ceiling panel 34. The ceiling panel 34 is upwardly inclined towards the center of the structure 10, providing a slightly outwardly sloping roofline.

The incline is preferred to be a 6.0 inch rise over approximately eight feet. As previously described, the inner arcuate edge of the ceiling panel is turned upward forming the peripheral flange 86 of said panel 34. This curvilinear rigid flange sealingly engages with the recess 100 of the annular ring 96 of the ceiling closure module 26 by fastening together the opposing attachment fittings 84*a–d* of the ceiling aperture 82 and the fittings located in the distending circular collar 94. FIGS. 1 and 10 show a different structure for the closure module 26 than shown in FIGS. 8 and 9. It need only be noted that the internal dimensional and mating requirements be met for the present invention. External structure and configurations need meet only use or environmental limits.

Ceiling panel 34, for the described example using four panel segments, is six feet two inches in overall length from its outer edge to its inner flange. Sidewall panel 14 is typically eight feet tall, as measured from its lower edge 64 to its upper edge 62. The overall diameter of the structure 10 approximates sixteen feet across the flooring platform 40 with an inward taper upward toward the ceiling of 4.0 inches. This results in an upper internal headroom diameter of fourteen feet eight inches, which takes into account the wall thickness dimension. The vertical headroom averages approximately eight feet across the ceiling, being slightly higher in the center of the structure 10. Other dimensions for the modular structure will be in accordance with the dimensions set forth for the discussed exemplary model.

Figure 11:
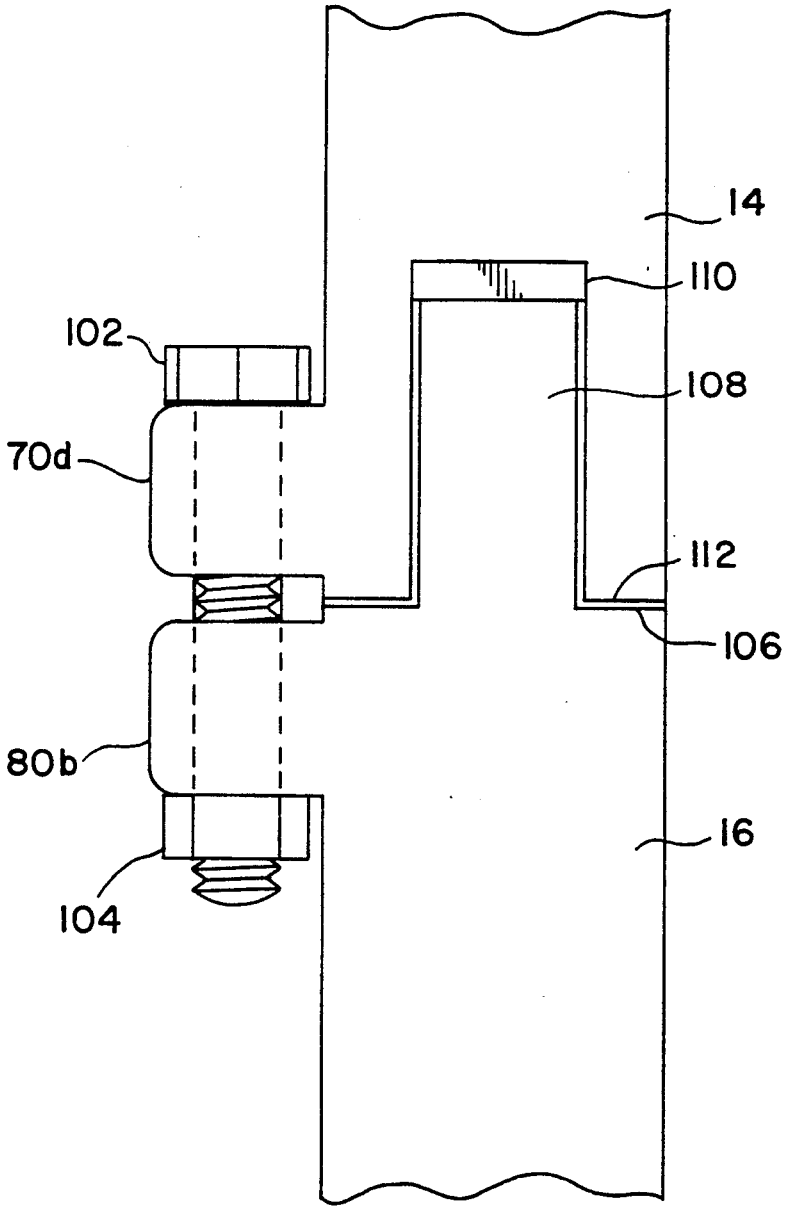
FIG. 11 is a fragmentary sectional view of a first means for securing two sidewall panel segments showing a tongue-and-groove joint and peripheral securing means for the conjoined sidewall panel segments.

The fragmentary sectional view of FIG. 11 shows a typical mortice and tenon joint providing the sealing engagement between abutting sidewall panels such as 14 and 16. Each of the attachment fittings, generally 60 for sidewall panel 12, 70 for sidewall panel 14, and 80 for sidewall panel 16, are located at or near abutting edges of the various panels. Each of the fittings, 60, 70 and 80 are aligned along the axis of a central aperture extending through each such fitting for the passage of a securing means therethrough. The securing means may be any of many suitable for the purpose of retaining the various panel segments in abutting sealing engagement, but for the purposes of this discussion, one exemplary securing means can be a threaded bolt 102 inserted through attachment fittings 70*d* and 80*b* for the external securing of the sidewall panels 14, 16 by applying a self-locking nut 104 to the threaded distal end of the bolt. Both the bolt 102 and nut 104 are of hardened nylon, with the attachment fittings 70*d*, 80*b* being of the same material as the panel segments. The bolt is nominally 1.0 inches in diameter and 6.0 inches in length with the self-locking nut 104 of similar corresponding sizing. Bolt length may vary depending upon the number of fittings it must span at a given location, e.g. the upper edge of two abutting wall panels when ceiling panel attachment is external to said panels.

As shown in FIG. 11, abutting sidewall panel edge 106 includes a projecting centrally located tongue 108 which is received and seated in the rectangular groove 110 of abutting and aligned sidewall panel edge 112. The tongue 108 and the groove 112 are coextensive along the entire length of the abutting panel edges 106, 112. Within the groove 110 of sidewall panel 14 is included a resilient rubber-like gasket means 118, which is fixedly secured to the back of the groove 110 by permanent epoxy welding or other suitable manner. When the securing means is tightened against the attachment fittings, the gasket means 118 is compressed against the back of the groove 110. This permits adjacent sidewall panels 14, 16 (as well as each of the several linear junctions between panels and inserts of the present invention) to be properly aligned and to be substantially air-tight, hermetic-like seal when placed into sealing engagement. The constriction of the securing means, i.e. the bolt 102 and the self-locking nut 104, of the abutting panel edges provides an almost hermetic seal.

Other linear juncture points exist between the top of the sidewall panels and the ceiling panels, the ceiling panels and the ceiling closure module, and (modified slightly) the bottom of the sidewall panels and the flooring panels. The exemplary manner of securing the various panels may be modified by placing the attachment fittings on the internal (or other) surface of the panels without departing from the spirit of the invention.

Figure 12:
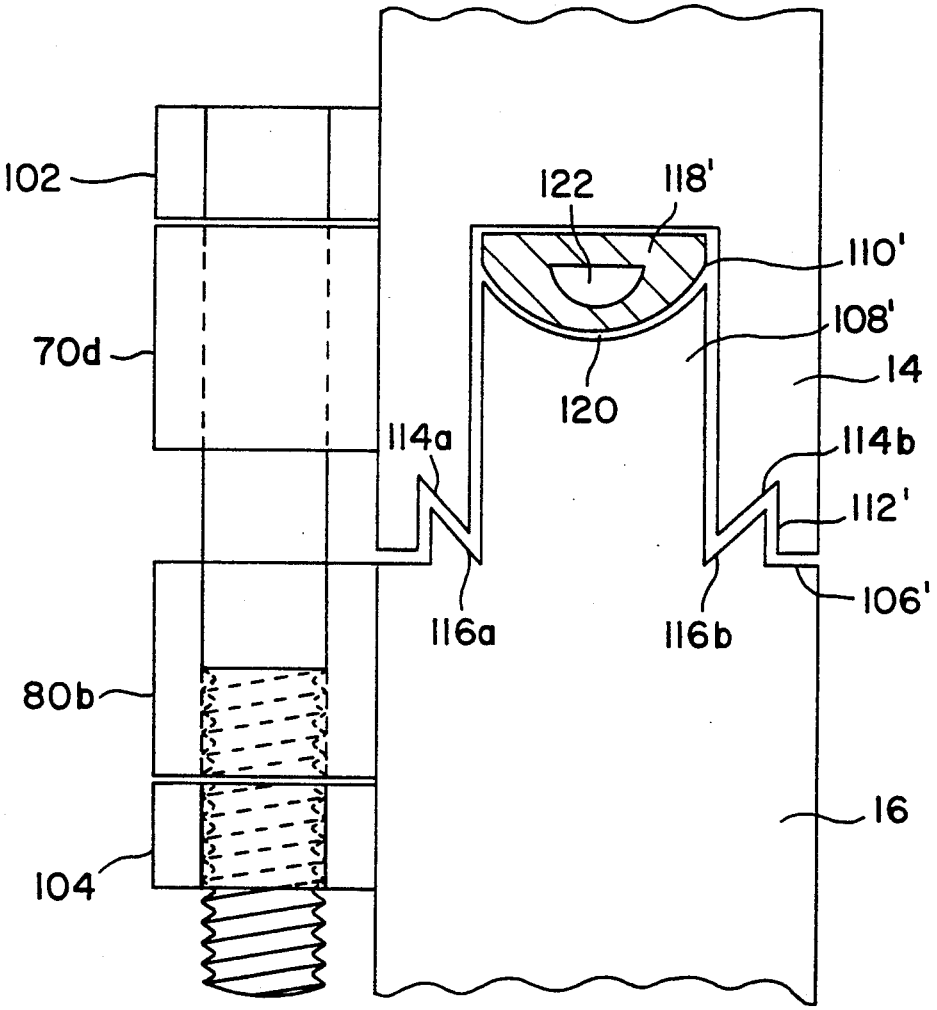
FIG. 12 is a fragmentary sectional view of a second means for securing two sidewall panel segments showing a modified tongue-and-groove joint and peripheral securing means for the conjoined sidewall panel segments.

A modified version of the tongue-and-groove abutting panel edge joint of FIG. 11 is depicted in FIG. 12. The external panel attachment fittings 70*d*, 80*b*, threaded bolt 102, and self-locking nut 104 function as earlier described. However, the tongue-and-groove configuration is somewhat altered. In the fabricating of the opposing lateral edges of adjacent sidewall panels 14, 16, a pair of V-shaped notches 114*a*, 114*b* is included on one panel edge and a corresponding pair of triangularly shaped flanges 116*a*, 116*b* is included on the opposing panel edge. This provides for an edge seating having a closer tolerance, with minimal chance for transverse flexing of joined panels due to internal or external pressure changes or differences.

The goal of an hermetic seal between the abutting panels is enhanced by the inclusion of a resilient rubber-like gasket 118' which is positioned in the arcuate recess 120 in the leading edge of tongue 108'. The gasket 118' extends along the entire length of the panel edge within the groove 110'. Having a preformed structure with a corresponding curved surface for mating with recess 120 and a semi-circular void 122 extending throughout the gasket 118', the gasket is compressed as the securing means is tightened causing a substantially air-tight seal between the panels. The flat side of the gasket 118' is fixedly secured against the back of the groove 110'.

Figure 13:
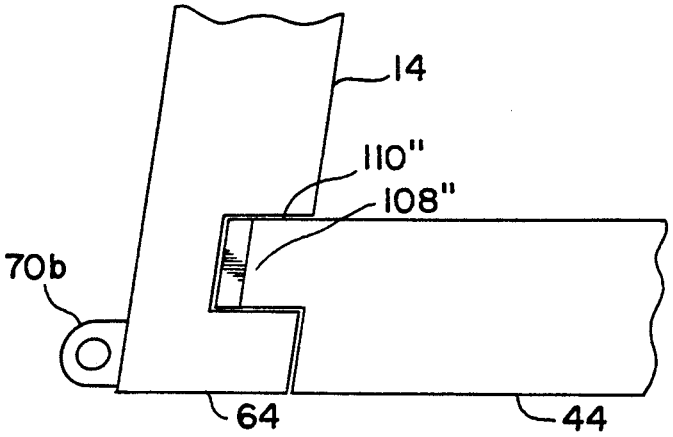
FIG. 13 is a fragmentary sectional view of a another means for securing a sidewall panel segment to a flooring panel segment showing a modified tongue-and-groove joint; and, FIG. 14 is a sectional view of the nested frame insert panel and additional modular predetermined function insert panel taken along line 14—14 of FIG. 1.

Another modified version of the tongue-and-groove joint of FIG. 11 is that depicted in FIG. 13. The sidewall panel 14 has at approximately its lower edge 64 a groove 110" into which extends a tongue-like projection 108". Both the tongue 108" and the groove 110" extend along the entire length of the opposing edges of the sidewall panel 14 and flooring panel 44. Further, both tongue 108" and groove 110" are configured to provide for the inward incline of the sidewall panel 14 by allowing the backwall of the groove 110" to be similarly inclined inwardly with the face of the tongue 108" correspondingly configured. With the assembly of the various sidewall panels 12, 14, 16, and 18, the flooring panels 42, 44, 46, and 48 are retained in a fixed arrangement, in sealing engagement with each other and with the corresponding sidewall panel. This sealing engagement is accomplished through the tightening of the securing means about the lower periphery of the various sidewall panels. For the description of the securing means and their respective functions, reference can be had to the discussion pertaining to FIGS. 11 and 12. With the securing means in position, each of the various joints between and among the flooring and sidewall panels create similar air-tight seals sufficient to create a substantial hermetic seal along the edge joints.

Additionally, a membrane may be added extending over the abutting surfaces of the panel edge of the panel having the "tongue-like" projection, e.g. sidewall panel 16. The membrane will assist in making the seal between the panels by providing a compressible material to fill any void in the lateral edges of the panels as the securing means is tightened.

Though not expressly shown in all cases, the various joints between and among the sidewall, ceiling, and flooring panels are intended to be provided with tongue-and-groove edges, as well external cooperating securing means and attachment fittings, to insure their respective sealing engagement, to virtually eliminate panel sag or misalignment, and to promote both individual segment, and overall structural integrity.

Figure 14:
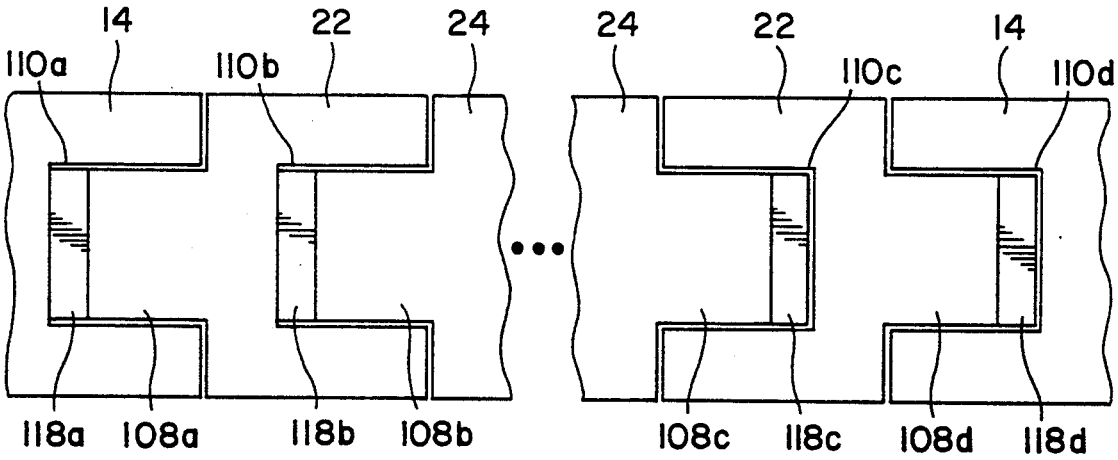

With reference to FIG. 14, there is shown the particular mating arrangement between the sidewall panel 14 and the nested frame insert panel and between the nested frame insert panel and the selected function insert panel. Similar tongue-and-groove joints are utilized to connect the nested frame insert panel 22 to the sidewall panel 14. As can be seen from FIG. 14, grooves 110*a* and 110*d* extend into the inward facing lateral edges of the sidewall panel 14 to align with and accept corresponding tongues 108*a* and 108*d*. Along the backside of grooves 110*a* and 110*d* are gasket means 118*a*, 118*d* which extend the entire length of the grooves 110*a* and 110*d* and are disposed intermediate the respective tongues and grooves. In identical manner, grooves 110*b* and 110*c* extend into the inward facing lateral edges of the nested frame insert panel 22 to align with and accept corresponding tongues 108*b* and 108*c*. Along the backside of the grooves 110*b* and 110*c* are gasket means 118*b*, 118*c* which extend the entire length of the grooves 110*b* and 110*c* and are disposed intermediate the respective tongues and grooves. The gasket means 118*a–d* are held fixedly in position by epoxy-type welding and are readily compressible. Each of the insert panels 24 are slidingly engaged within the sidewall panel 14 and nested frame insert panel 22, respectively, are slidingly engaged within the sidewall panel and nested frame insert panel, respectively, entering the grooves 110*a–d* from the bottom edge 64 of the sidewall panel 14.

The nested frame insert panel 22 has approximate overall dimensions of 40 inches in width and 84 inches in height. This accommodates the 4.0 inches height needed across the bottom of the sidewall panel opening 20 to complete the sealing engagement with the cooperative flooring panel and to accommodate an operable door module. Further, each of the protruding tongues 108*a*, 108*d* measure approximately 2.0 inches in length. The various selectable (operational or non-operational) insert panels 24 have approximate overall dimensions of 36 inches in width by 80 inches in height. These dimensions are sufficient to accommodate an operable door having an approximate width of 30 inches and height of 78 inches, or a window of the same width and a height of less than the maximum dimension, but usually in the range of 48 inches. This nested arrangement provides for the easy exchange of modular components of similar dimension permitting different functions, i.e. door, window, wall. In this manner the structure 10 can be set up to conform to any desired utility needing only a supply of insert panels 24 to suit the chosen utility.

In a preferred embodiment, a shelter/storage assembly of the present invention comprises four, essentially rigid pre-formed sidewall panels, four ceiling panels, and four planar pie-shaped flooring panels, with corresponding ceiling closure and floor locking modules, all cooperating to provide a lightweight, insulated and non-corrodible structure of one, or several interconnected units, of useful enclosed space. Each of the component panels is easily maintained, repaired, or replaced, if damaged beyond repair. The system is adaptable to a variety of climactic environments or terrains, providing an insulated and selectably controlled internal environment regardless of the external conditions, with a minimum insulation R-value rating of R-30.

The lock-together panel erection means provides for almost air-tight units, well suited for uses such as storage of bulk solids or liquids, and partly compressed gases. Another use of the assembled structure is for personnel for housing, office or storage. With the effective sealing of the assembled structure against outside conditions, the internal environment can be selectably controlled depending upon the particular use of the structure. Further, the structure may be coupled with other like structures in a matrix, forming a combined work/rest structure with freedom to move about the coupled structures. An assembled structure, or interconnecting network of structures, offers the occupants protection from climate or secure storage facility.

It is a particular feature of the present invention to be able to utilize a minimum number of flooring panels (4) with a greater number of wall and corresponding ceiling panels (8) to create a larger structure having a different outside configuration (i.e. door, window, wall insert placement) than the described structure 10. Although the "footprint" of the larger structure may be the same or larger in diameter, the ability to connect to another structure of the same, or larger, or smaller size is not diminished. A matrix of structures of differing sizes and uses is contemplated as part of the present invention by interconnection in the desired configuration.

The depicted modular structure, in single unit form, will be substantially circular, with coupled units looking something like a honeycomb from above. A single modular structure will have an approximate weight of one half ton when erected. Such unit, in accordance with the disclosed example will have the following dimensions:

| | Internal | External |
|---|---|---|
| Central Height | 8' 6" | 9' 8" |
| Floor Diameter | 15' 4" | 16' 0" |
| Floor Area (Ft.$^2$) | 184.5 | 201 |
| Volume (Ft.$^3$) | 1522.1 | 1708.5 |

The modular structure system can be assembled, or taken down, by a two-man team in a few hours. Even a single assembled unit is still of dimensions and overall weight adapted to be air-lifted and transported by helicopter over any terrain to a prepared remote site. It will be seen that high density storage of knocked-down units, by panel stacking and nesting, provide for high density storage and/or module transport.

The present invention may be embodied in other specific forms without departing from the spirit or essential attributes thereof, and, accordingly, reference should be made to the appended claims, rather than the foregoing specification, as indicating the scope of the invention.

I claim:

1. A portable pre-fabricated modularized clusterable structure means adapted for hermetic sealing, pressurized storage operation, and environmental isolation comprising:

a. a plurality of substantially wedged-shaped, flooring panels being adapted in number and arcuate lengths such that when conjoined along their respective lateral sides a substantially circular, continuous planar flooring is formed;

b. a plurality of upstanding curvilinear sidewall panels being adapted in number and arcuate lengths such that when conjoined along their respective lateral sides a continuous frustum-like, sidewall panel assembly is formed, having an upper central opening smaller than a lower central opening and a periphery that coincides with the outer periphery of the assembled flooring panels;

c. a plurality of substantially wedge-shaped ceiling panels, being adapted in number and arcuate lengths such that when conjoined along their respective lateral sides a continuous conical ceiling panel assembly is formed having an outer peripheral edge that coincides with the underlying frustum-like sidewall panel assembly along the upper edge of said sidewall panel assembly, said ceiling panel assembly having another central opening along the inner edges of the ceiling panel assembly substantially smaller than the upper central opening created by the assembled sidewall panels;

d. a generally rounded ceiling closure module, adapted to engage, along its peripheral undersurface, with the inner edges of the assembled ceiling panels;

e. modular insert panels adapted for interchangeable insertion in one or more sidewall panels; and f. one or more insertable frame panels interposed in sealing engagement between said sidewall panels and said modular insert panels providing support to said insert panels and a substantially vertical mating surface for interconnection between two or more structure means.

2. The structure means of claim 1 wherein the inner edges of said ceiling panels are flanged upwardly presenting a configuration for making sealing engagement with the ceiling closure module.

3. The structure means of claim 2 wherein the undersurface periphery of the ceiling closure module is provided with an annular recess adapted to receive the upwardly flanged inner edges of the conjoined ceiling panel assembly.

4. The structure means of claim 1 wherein the sidewall panels are at least four in number, having a corresponding number of ceiling panels, for forming the sidewall panel and ceiling panel assembly.

5. The structure means of claim 1 wherein the sidewall panels are even multiples of four or more of said sidewall panels, having a corresponding number of ceiling panels, for forming the sidewall panel and ceiling panel assembly.

6. The structure means of claim 1 wherein the sidewall panels are at least four in number, having the same or a lesser number of ceiling panels, for forming the sidewall panel and ceiling panel assembly.

7. The structure means of claim 1 wherein the sidewall panels are even multiples of four or more of said sidewall panels, having the same or a lesser number of ceiling panels, for forming the sidewall panel and ceiling panel assembly.

8. The structure means of claim 1 wherein said modular insert panels being one of a group of insert panels consisting substantially of continuous wall, window means and door means.

9. The structure means of claim 8 wherein said window means and door means insert panels are operable.

* * * * *